United States Patent [19]

Kim

[11] Patent Number: 4,499,672

[45] Date of Patent: Feb. 19, 1985

[54] SHOES SOLE FOR VENTILATION AND SHOCK ABSORPTION

[76] Inventor: Sang Do Kim, 433-63, Youl Jun-Dong, Su Won-City, Kyung Ki-Do, Rep. of Korea

[21] Appl. No.: 451,427

[22] Filed: Dec. 20, 1982

[51] Int. Cl.[3] ..... A43B 7/06; A43B 13/20

[52] U.S. Cl. ..... 36/3 B; 36/29; 36/35 B

[58] Field of Search ..... 36/3 R, 3 B, 29, 35 B

[56] References Cited

U.S. PATENT DOCUMENTS

| | | | |
|---|---|---|---|
| 616,112 | 12/1898 | Kennedy | 36/3 R |
| 635,101 | 10/1899 | Kennedy | 36/3 B |
| 1,932,557 | 10/1933 | Meucci | 36/3 R |
| 2,559,609 | 7/1951 | Foust | 36/3 R |
| 2,720,041 | 10/1955 | Kattar | 36/3 B |
| 4,078,321 | 3/1978 | Famolare, Jr. | 36/3 B |
| 4,215,492 | 8/1980 | Sandmeier | 36/3 B |

FOREIGN PATENT DOCUMENTS

| | | | |
|---|---|---|---|
| 910813 | 6/1946 | France | 36/3 B |
| 142267 | 5/1920 | United Kingdom | 36/3 B |

*Primary Examiner*—Henry S. Jaudon
*Assistant Examiner*—Steven N. Meyers
*Attorney, Agent, or Firm*—Parkhurst & Oliff

[57] ABSTRACT

A shoe sole having ventilating openings between the atmosphere and the interior of the shoe. The air flows through sealable openings in the heel and enters the interior of the shoe through further openings in the foot engaging portions of the sole. The openings in the heel are sealable by keys which close the openings upon application of pressure by the heel of the user when walking.

5 Claims, 7 Drawing Figures

FIG. 2
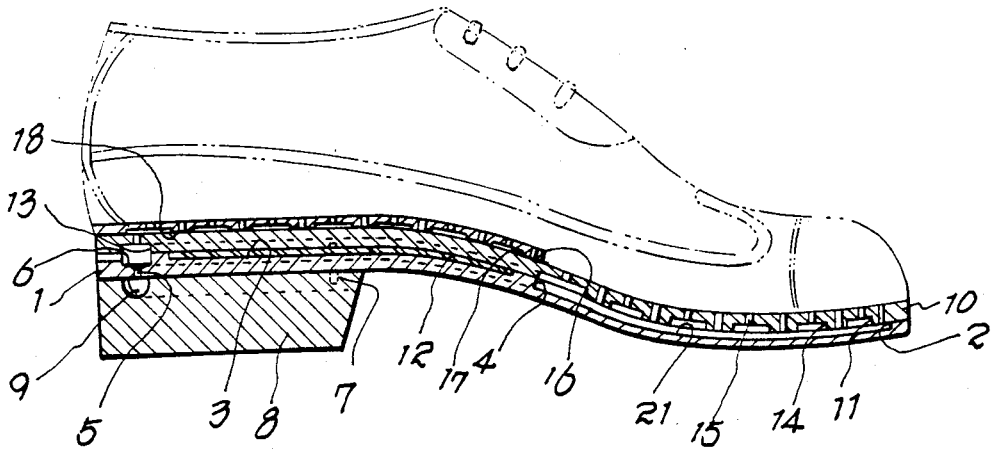
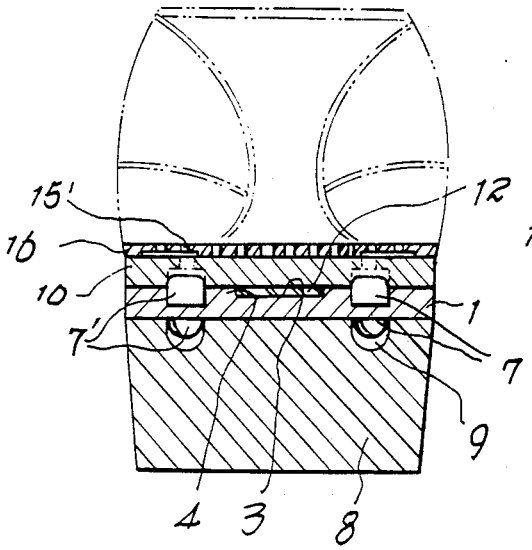
FIG. 3A
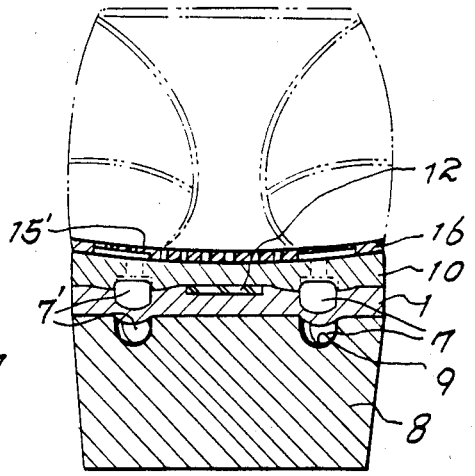
FIG. 3B

SHOES SOLE FOR VENTILATION AND SHOCK ABSORPTION

BACKGROUND OF THE INVENTION (1) Field of the Invention

This invention relates to which keeps the inner side of shoes dry by ventilating the air in shoes, providing the walker with a comfortable feeling as well as removing the bad smell emitted from the inside of shoes by establishing a hollow zone between the outersole and the innersole (2) Description of the Prior Art In traditional shoes, there has been one or two ventilating openings on the side of shoes, numorous ventilating holes on the top of shoes for ventilating the air in the shoes. In addition, for the same purpose, the vamps or the uppers of shoes are made of gauze for use in the summer season.

Nevertheless, because the sole of the foot is stuck to the innersole or the outersole while in shoes, such ventilation is only local in nature. As a result, the above techniques could not prevent odors or athlete's foot.

SUMMARY OF THE INVENTION

The shoe sole of the present invention includes a first embodiment having four main parts (i.e., the heel, the outersole, the hucklebone, the innersole and the half top), and a second embodiment having five main parts, (i.e. the incorporation of the heel and the outersole, the hucklebone, the innersole and the half top). In the first embodiment, a U-shaped air exit is established on the heel alongside the edge thereof. In the second embodiment, a number of side air exits are formed on the outer edge of the heel. In both embodiments, a hucklebone room and a hollow zone are established on the outersole. In addition, the shoe soles include a number of narrow ventilating holes which penetrate the innersole, two water-proof keys, a hucklebone lid, numorous downward projections beneath the innersole, and numorous round ventilating holes which penetrate on the innersole. Furthermore, the soles include numorous round ventilating holes which penetrate on the half top and several supporting bridges beneath the half top.

It is a feature of the shoe sole of the present invention to remove the aforesaid traditional defaults by keeping the inside of the shoes dry and well ventilated by establishing air exit(s) in the heel.

It is a further feature of the invention to provide a shoe sole which cushions the feet during use and creates a feeling of dryness by use of numorous projections beneath the innersole which are highly effective in ventilating odors of the foot as well as in preventing athlete's foot.

BRIEF DESCRIPTION OF THE DRAWINGS

FIG. 2 is the cross section of the combination of the parts of the present invention;

FIG. 3 (A) is the enlarged longitudinal section of the heel of the present invention under normal conditions FIG. 3 (B) is the enlarged longitudinal section of the heel of the present invention showing the air exit being shut while putting on shoes;

LEGEND

| | | | |
|---|---|---|---|
| 1. | outersole | 2, 2' | fence of the outersole |
| 2'', | extrusion | 3, 3' | hucklebone room |
| 4, 4' | hucklebone supporting plate | 5. | narrow ventilating hole |
| 6. | hollow zone | 7, 7' | water-proof key |
| 8, 8' | heel | 9. | air exit |
| 10. | innersole | 11. | fence of the innersole |
| 12. | hucklebone | 13. | hucklebone lid |
| 14. | projection | 15, 15' | round ventilating hole |
| 16. | half top | 17. | fence of the half tap |
| 18. | supporting bridge | 19. | incorporated shoe sole |
| 20. | side air exit | 20' | hollow alley |
| 21. | hollow zone of the front side | | |

DETAILED DESCRIPTION OF THE INVENTION

Figure 1:
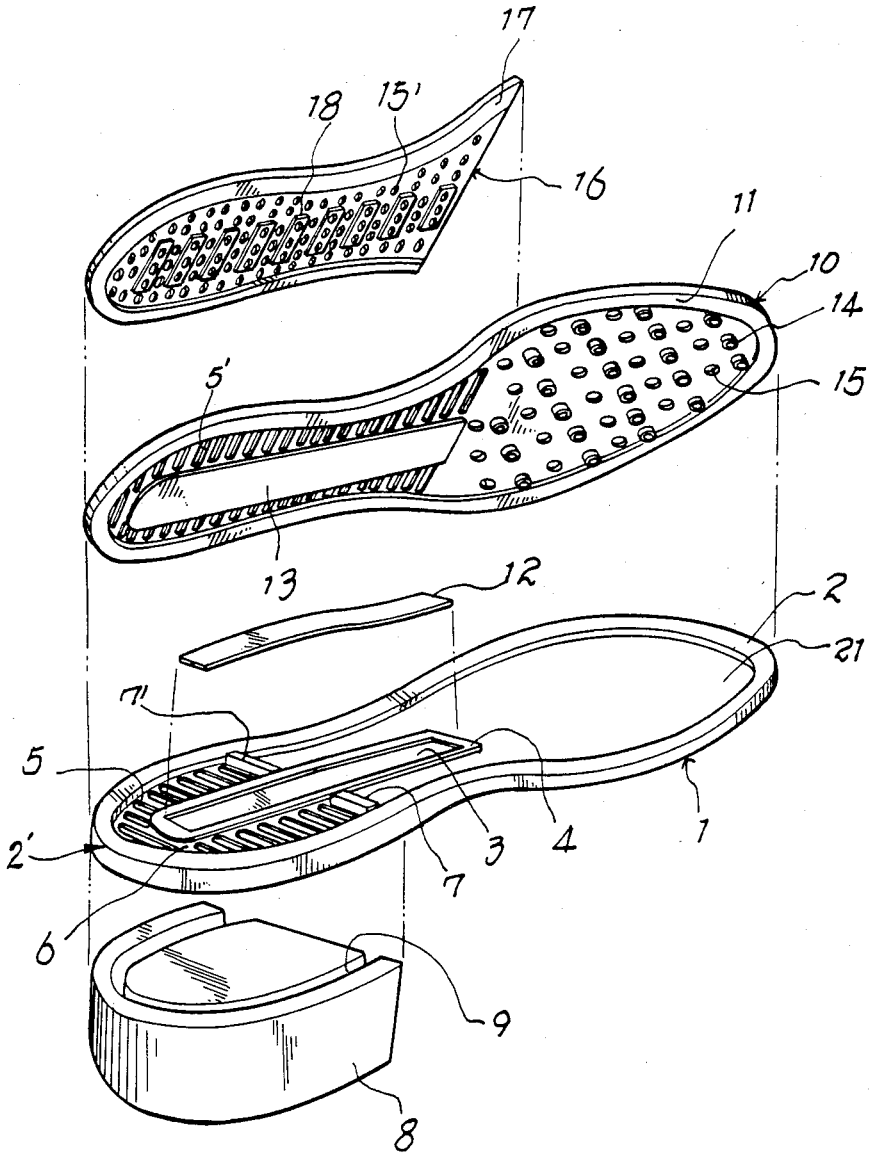
FIG. 1 is the exploded view of the present invention

As illustrated in the FIG. 1, along the outer edge of the outersole (1) there is an upwardly projecting fence (2). On the outersole adjacent a heel (8) there is a hucklebone room (3) on the hucklebone supporting plate (4), a number of narrow ventilating holes (5) and two water-proof keys (7)(7') at both ends of the arrangement of the narrow ventilating holes between the supporting plate (4) and the fence (2). On the heel (8), a U-shaped air exit channel (9) is established, will be positioned below the narrow ventilating holes (5) and the water-proof keys (7, 7', each having portions projecting from the upper and lower surface of said outer sole as shown in FIGS. 3*a* and 3*b*) when the outersole (1) and heel (8) are joined together.

Figure 4A:
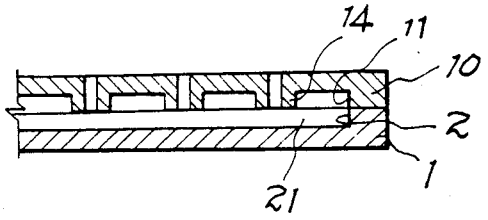
FIG. 4 (A) is the cross section of the combination of the outersole and the innersole under normal conditions FIG. 4 (B) is the cross section of the combination of the outersole and the innersole while putting on shoes.
Figure 4B:
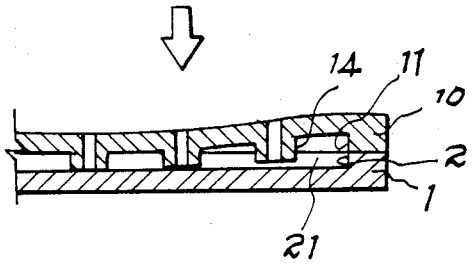

Further, beneath the outer edge of the innersole (10), there is a fence (11) established to abut the fence (2) of the outer sole (1). On the innersole (10) adjacent the heel (8) there is a hucklebone lid (13) which extends to the middle of the innersole (10) and a number of narrow ventilating holes (5') between the hucklebone lid (13) and fence (2). Beneath the front side of the innersole (10), a number of round ventilating holes (15) and projections (14) (having openings therethrough (FIG. 4)) equal in height to the fence (11) are alternately established. In addition, there is a fence (17) projecting downwardly along the outer edge of the tap (16), numorous round ventilating holes (15') and several supporting bridges (18) equal in height to the fence (17) along the center line of the half top (16). Accordingly, the heel (8), the outersole (1), the hucklebone (12), the innersole (10) and finally the tap (16) are coupled to one another in the manner shown in FIG. 2 to form the shoe sole of the present invention.

Figure 5:
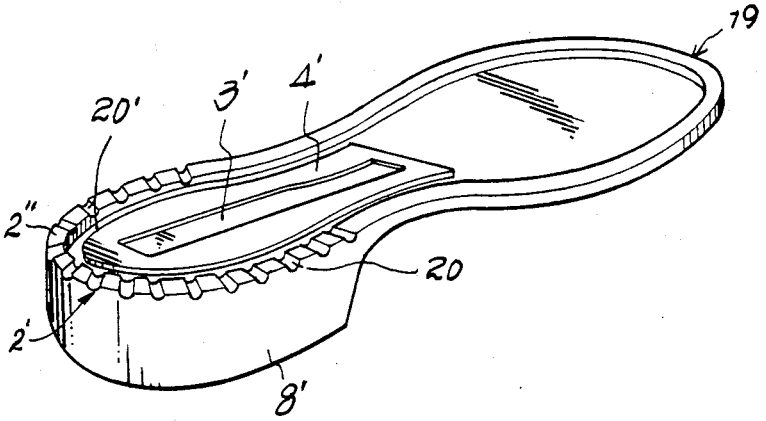
FIG. 5 is the illustration of the incorporation of the heel and the outersole when the two are manufactured as one body.

An alternative embodiment is illustrated in FIG. 5, wherein the heel (8) and the outersole (1) are to be manufactured as one body. In this instance a number of extrusions (2'') are established along the rear fence (2') of the combined shoe sole (19) to form the side air exits (20). Also the hucklebone (12) and the supporting plate thereof (4') are formed as explained above in connection with FIG. 1. Additionally, between the extrusion (2'') and the supporting plate (4') is a hollow zone (20') and a hucklebone room (3') in the middle of the supporting plate (4') established is the hucklebone room (3').

In light of the structure of the present invention, when the innersole (10) and the outersole (1) are adhered to each other by an adhesive agent, the hucklebone lid (13) and the hucklebone supporting plate (4) (4') engage the hucklebone (12), while the fence (11) of the innersole (10) and the counterpart fence (2) (2') (2'') of the outersole (1) are in alignment with one another respectively. Accordingly, the air exit (9) or the side air exits (20) on the heel (8) (8') will communicate with the narrow and round ventilating holes (5) (5') (15) through the hollow zone (12).

In the combined shoe sole of FIG. 5, the air may enter into or be emitted through the side air exits (20) via the narrow ventilating holes (5), the hollow zone (6), the hollow alley (20'), the hollow zone (21) of the front side and the narrow ventilating holes (15'). Since the innersole (10) has numorous projections (14), it will cause emittion and absorption of the air as well as cushion the feet while walking. As illustrated in FIG. 3, the waterproof keys (7, 7') will keep away the water on rainy days becasue the water-proof keys (7) (7') are pressed by the weight of the wearer to close the air exit (9) so as to keep the shoes clean and dry.

What is claimed is:

1. A shoe sole comprising:

an outersole having an upper surface and lower surface forming a forward portion and a heel portion and having at least one ventilating hole extending between said upper and lower surface in said heel portion and at least one waterproof key having portions projecting from said upper and lower surface between said heel and forward portions; and a heel coupled to the lower surface of said heel portion of said outersole having a channel extending through said heel which communicates with said at least one ventilating hole, said channel having at least one portion which opens external to said heel and being positioned such that one portion of said at least one waterproof key projects into said at least one portion to close said channel from opening external to said heel in response to weight on said heel portion.

2. A shoe sole comprising:

an outersole having an upper surface and lower surface forming a forward portion and a heel portion and having ventilating holes extending between said upper and lower surface in said heel portion and at least one waterproof key having portions projecting from said upper and lower surface between said heel and forward portions, said heel portion and forward portions being surrounded by an upstanding edge on said upper surface;

a heel attached to the lower surface of said heel portion of said outersole and having a channel extending through said heel which communicates with said plurality of ventilating holes, said channel having at least one portion which opens external to said heel and being positioned such that one portion of said at least one waterproof key projects into said at least one portion to close said channel from opening external to said heel in response to weight on said heel portion;

an innersole having an upper surface and a lower surface forming a heel portion and a forward portion of the same shape as the shape of said outersole, said heel portion and forward portion of said innersole being surrounded by an upstanding edge on said lower surface of said innersole, said heel portion and forward portion having a plurality of openings between said upper and lower surface of said innersole, said forward portion having a plurality of projections extending from the lower surface of said innersole, and said upstanding edge of said innersole being coupled to said upstanding edge of said outersole so that the shapes of the inner and outersole are in substantial alignment; and a half top having an upper surface and a lower surface with supporting bridges projecting from said lower surface of said half top, said half top being coupled to the upper surface of said innersole and having openings extending between the upper and lower surfaces of said half top.

3. The shoe sole of claim 2 wherein said projections extending from the lower surface of said innersole are of the same height as the upstanding edge on said lower surface of said innersole, and said projections include openings extending therethrough between the upper and lower surfaces of said innersole.

4. An integral heel and shoe sole comprising:

an integral outersole having a heel portion and a forward portion integrally coupled to said heel portion to form an upper surface and lower surface of said outersole, said outersole having a heel integrally extending from said lower surface;

an upstanding edge surrounding said heel portion and forward portion along the upper surface of said outersole;

at least one opening extending through said upstanding edge around said heel portion; and an innersole having an upper surface and a lower surface forming a heel portion and a forward portion of the same shape as said outersole, said lower surface of said innersole having an upstanding edge surrounding said heel portion and forward portion of said innersole, said heel portion and forward portion of said innersole having a plurality of openings between said upper and lower surfaces of said innersole, said forward portion of said innersole having a plurality of projections extending from the lower surface of said innersole, and said upstanding edge of said innersole being coupled to said upstanding edge of said outersole so that the shapes of the inner and outersole are in substantial alignment.

5. The shoe sole of claim 4 wherein said at least one opening is a plurality of openings.

* * * * *